United States Patent [19]

Schlaefli

[11] Patent Number: 4,760,668

[45] Date of Patent: Aug. 2, 1988

[54] SURFACE GRINDING MACHINE AND METHOD

[76] Inventor: Alfred Schlaefli, Verger-en Joran 14, 2074 Marin, Switzerland

[21] Appl. No.: 65,477

[22] Filed: Jun. 23, 1987

[30] Foreign Application Priority Data

Jul. 2, 1986 [CH] Switzerland ..... 2658/86

[51] Int. Cl.[4] ..... B24B 7/02; B24B 53/00

[52] U.S. Cl. ..... 51/5 D; 51/122; 51/165.87; 51/325

[58] Field of Search ..... 51/5 D, 56 R, 112, 113, 51/114, 121, 122, 165.87, 165.88, 262 T, 281 SF, 325

[56] References Cited

U.S. PATENT DOCUMENTS

| | | | |
|---|---|---|---|
| 3,110,988 | 11/1963 | Boettcher | 51/131.2 |
| 3,353,305 | 11/1967 | Wolf et al. | 51/122 X |
| 4,226,055 | 10/1980 | Komanduri et al. | 51/325 |
| 4,404,774 | 9/1983 | Sadao | 51/5 D X |
| 4,475,321 | 10/1984 | Meyer | 51/325 |

FOREIGN PATENT DOCUMENTS

| | | |
|---|---|---|
| 2106167 | 4/1972 | France . |
| 362618 | 7/1962 | Switzerland . |

*Primary Examiner*—Robert P. Olszewski

*Attorney, Agent, or Firm*—Pollock, Vande Sande and Priddy

[57] ABSTRACT

In order to avoid the undulation of tolerance and to reduce the time and cost of grinding, the machine and method carry out a continuous dressing of the abrasive rim by a lateral cutter-wheel. A bell grinding-wheel and its rim are moved axially in a slow movement just exceeding the amount of attrition of the grinding-wheel. Thus the abrasive rim is continuously redressed. The level of the uppermost generatrix of the diamond cutter-wheel above a table exactly determines the thickness of the ground workpiece. The cutter-wheel is rotated by a motor; a rolling effect may occur. This machine and method are suitable for very precise mass-production grinding of industrial workpieces.

19 Claims, 9 Drawing Sheets

FIG. 4
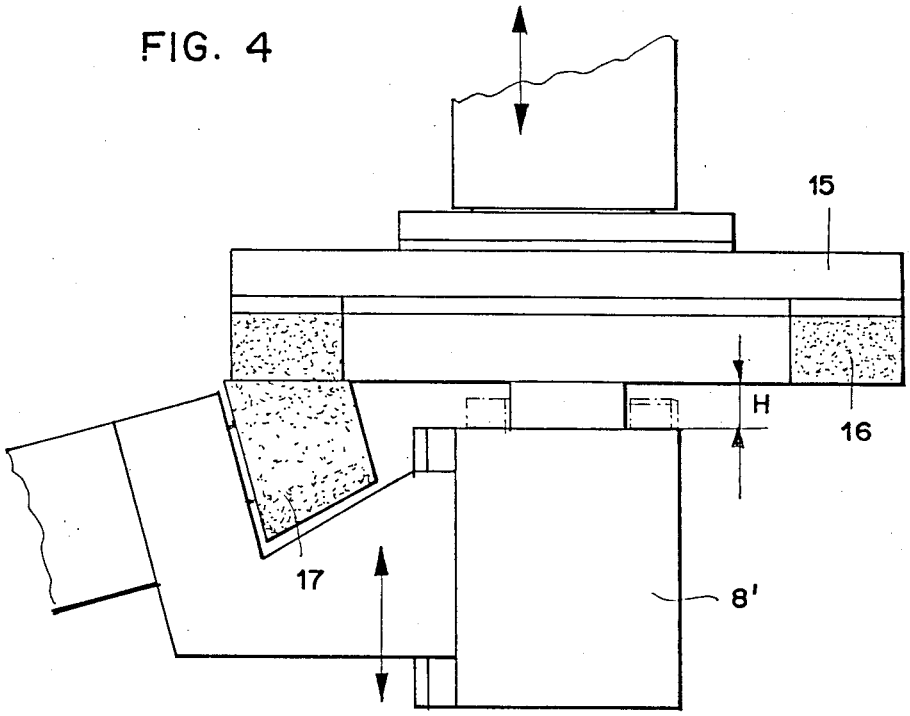
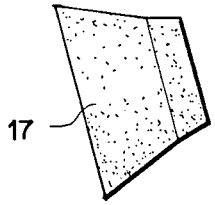
FIG. 4a
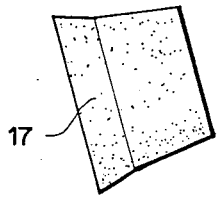
FIG. 4b

SURFACE GRINDING MACHINE AND METHOD

BACKGROUND OF THE INVENTION

This invention relates to the art of plane grinding with the aid of a bell grinding-wheel working axially, and more particularly to a machine for grinding at least one flat surface with the aid of at least one rotary grinding-wheel, of the type having a frame supporting at least one rotary grinding-wheel, means for driving the grinding-wheel rotatingly, positioning means suitable for receiving and placing parts having a surface to be ground, mutual translatory displacement means for displacement between the rotary grinding-wheel and the parts disposed in the positioning means, and a diamond cutter-wheel for dressing or redressing the grinding-wheel.

The invention further relates to a method of grinding at least one flat surface with the aid of at least one rotary grinding-wheel.

The various principles of this art, as well as the principles of grinding in general, are best defined at the present time in the manual entitled *Begriffe der Schleiftechnik*, by E. Salgie and H. Brandin, published by Vulkan Verlag in Essen, West Germany.

In the prior art, the grinding of flat surfaces with the aid of a bell grinding-wheel working axially has been practiced in a manner which leaves "jagged" inequalities within the prescribed zone of tolerance. Chiefly known are ordinary grinding-wheels necessitating frequent redressing (also called truing or diamond grinding), for the grinding-wheel, while working, not only wears down but tends to gum up. Generally, but not necessarily, the grinding-wheel is trued at the same time as it is reset to the minimum dimension of the tolerance. In normal operation, the grinding-wheel does not sink axially, so that the thickness of the ground workpiece increases within the zone of tolerance. When the maximum dimension permitted by the tolerance is reached, or almost reached, this is detected by a comparator acting upon the ground workpieces, and the grinding-wheel is disengaged from the grinding zone to be lowered, then trued or dressed, operation then resuming from the minimum dimension of the tolerance.

Also known are so-called "self-dressing" grinding-wheels. These have the distinctive characteristic of always remaining very abrasive inasmuch as blunted particles are automatically torn away owing to the special composition of the bonding agent of the grinding-wheel. However, the amount of wear can never be foreseen, and the thickness of the workpiece must likewise be measured with the aid of a comparator. Wear naturally takes place more rapidly than with a grinding-wheel of the normal type, and the maximum dimension of the tolerance is reached rather quickly. When this situation is detected, the grinding-wheel is lowered slightly during the next few grinding operations, by at least more than the extent of the attrition. The dimension then begins to decrease within in the tolerance, and lowering of the grinding-wheel is stopped when the minimum dimension is reached. Thus, within the prescribed tolerances, there is likewise a "jagged" distribution of the real dimensions.

The second type of known grinding-wheel mentioned above has the drawback of being expensive, all the more so as attrition is more rapid. It also has quite some drawbacks from the point of view of the environment; and although it eliminates the necessity for truing, it does not eliminate the drawback of "jagged" distribution of dimensions.

Neither do French Pat. No. 2,106,167 and Swiss Pat. No. 362,618 offer any solution to the drawbacks set forth. Thus, the French patent describes a machine of the type to which the present invention relates but does not propose permanent and continuous dressing of the grinding-wheel; no dressing cutter is provided for that purpose. The Swiss patent, on the other hand, does provide for such cutter-wheels, but continuous dressing is not ensured there, either, for these cutters operate alternately, and dressing takes place conventionally, whenever it proves to be necessary by interrupting the grinding operations.

SUMMARY OF THE INVENTION

It is an object of this invention to provide an improved grinding machine and method allowing continuous grinding, always with the same dimension, without the above-mentioned "jagged" distribution of dimensions.

A further object of the invention is to provide a grinding machine and method allowing rapid, precise, and inexpensive grinding of work pieces in medium-scale and large-scale production.

To this end, in the grinding machine according to the present invention, of the type initially mentioned, the grinding-wheel is a bell grinding-wheel having an abrasive rim and a recessed inner area of a certain diameter, this grinding-wheel having its axis of rotation at least approximately perpendicular to the surface to be ground; the positioning means and the mutual translatory displacement means are arranged to bring the surface of the workpieces to be ground along a grinding path at least approximately perpendicular to the axis of the bell grinding-wheel and passing opposite the bell grinding-wheel, this path being less wide than the diameter of the mentioned inner area and therefore crossing the rim of the bell grinding-wheel at two points of intersection; a grinding-wheel-dressing diamond cutter-wheel disposed on one side of the path, under the rim of the grinding-wheel, to furnish the latter with a dressing generatrix in the plane of the surface to be ground; and means for imparting to the grinding-wheel a slow axial movement, corresponding at least to the specific grinding-wheel wear, for ensuring continuous dressing of the abrasive rim of the grinding-wheel against the cutter-wheel, at a level continuously defining the plane of grinding of the surface to be ground.

In the method according to the present invention, a bell grinding-wheel, having an abrasive rim and a recessed inner area of a certain diameter, is moved rotatingly on an axis at least approximately perpendicular to the surface to be ground; one or more workpieces having this surface to be ground are disposed on a grinding path which passes opposite the grinding-wheel and which is at least approximately perpendicular to the axis of the latter, this path, less wide than the diameter of the mentioned inner area, crossing the latter and intersecting the rim at two points of intersection; a mutual translatory movement takes place, along the path, between the grinding-wheel and the workpieces; a grinding-wheel-dressing diamond cutter-wheel is disposed on one side of the path, under the rim, so as to furnish the latter with a dressing contact in the plane of the surface to be ground; and the grinding-wheel undergoes a slow axial movement in the direction of the workpieces and the cutter-wheel, ensuring continuous dressing of the abrasive rim against the cutter-wheel so as to define continuously the grinding plane of the mentioned surface.

In the course of the present specification, certain embodiments of the invention are particularly advantageous from the point of view of design and construction and/or operation.

The following remarks may be made at the outset concerning the invention (or, as regards certain remarks, at least certain embodiments):

It is important that the grinding-wheel be of the bell type, preferably not conical; the invention advantageously avoids the necessity of using a self-dressing grinding-wheel. The lateral perpendicularity of the axis of the grinding-wheel relative to the table must be very precise; the machine includes means for adjusting it with great precision.

In the longitudinal direction, the axis of the grinding-wheel may be very slightly deviated from the perpendicular to place the rim of the grinding-wheel lower at its second point of intersection with the surface to be ground than at the first point.

Preferably, the cutter-wheel is rotated by an electric motor, which is advantageously of a type with speed control, e.g., a universal commutator motor.

In one case, the cutter-wheel has a peripheral speed equal to that of the grinding-wheel. In another case, the peripheral speed of the cutter-wheel differs from that of the grinding-wheel; it may be less. The cutter-wheel may also rotate in the opposite direction from the grinding-wheel. In the former case, there is a rolling effect between the cutter-wheel and the grinding-wheel which dresses the grinding-wheel with a high degree of cutting, ensuring great efficacity of abrasion. In the other case, the friction effect dresses the grinding-wheel with a less cutting grain, ensuring great fineness of the ground surface. In principle, the speed of rotation of the cutter-wheel is never zero.

Grinding takes place with heavy lubrication; the grinding speeds are on the order of 10 to 100 m/sec, typically 40 m/sec. The grinding-wheel has a large diameter—60, 90, even 120 cm—and typically rotates at about 1,000 rpm.

The conicity of the cutter-wheel is calculated so that the ratios of radius between the grinding-wheel and the cutter-wheel correspond, in order to ensure the rolling effect.

The grinding depth is exactly established by the position of the cutter-wheel above the table; with the grinding principle proposed, a dimension-checking comparator is no longer a necessity.

The feed of the workpieces (or workpiece) takes place on a fixed or sliding table for very precise grinding; it may also take place by means of a belt, the thickness of which must then be taken into account.

Like most such large-diameter bell grinding-wheels, the one used in the invention is made in segments.

It should be noted that the conical cutter-wheel may have a straight generatrix (integral rolling effect) or a shape such that the generatrix is slightly angled to obtain an angle of bite at the outside or at the inside of the grinding-wheel. In this case, the rolling effect is not integral along the whole generatrix of the cutter-wheel, but the deviation is negligible.

The machine and method proposed in this invention allow continuous grinding, requiring no interruption for redressing the grinding-wheel. The proposed method is therefore particularly economical for high-precision flat grinding in mass production.

BRIEF DESCRIPTION OF THE DRAWINGS

Preferred embodiments of the invention and various modifications thereof will now be described in detail with reference to the accompanying drawings, in which:

FIG. 4 is a diagrammatic partial elevation, partially in section, illustrating the principle of the method based upon another embodiment of the machine, FIGS. 4*a* and 4*b* are detail views illustrating possible modifications of the frustoconical cutter-wheel shown in FIG. 4.

DETAILED DESCRIPTION OF THE PREFERRED EMBODIMENTS

Figure 1:
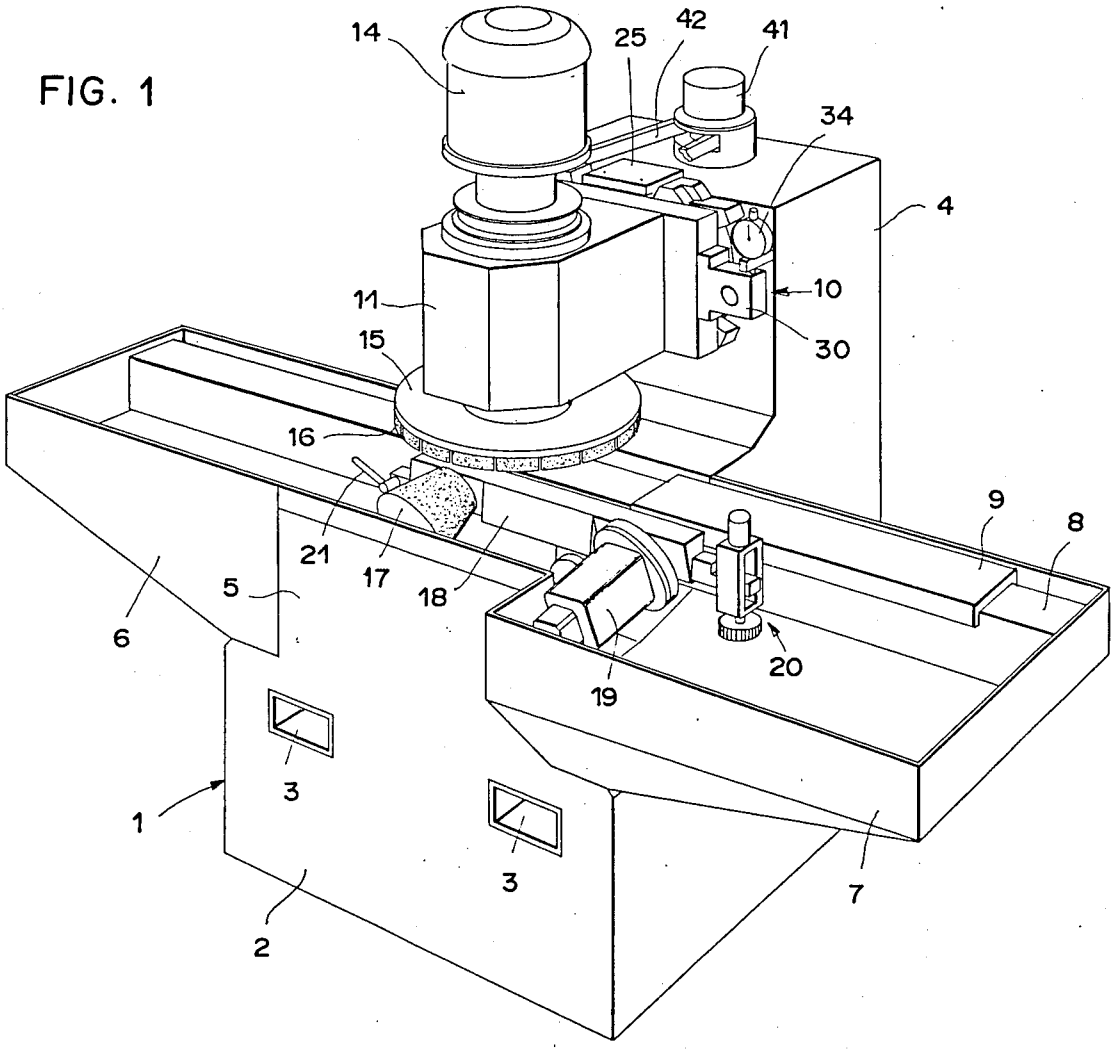
FIG. 1 is an overall perspective view of an embodiment of a grinding machine according to the invention.

FIG. 1 shows the general design of the machine. In the following description of this design with reference to FIG. 1, consideration of other drawing figures, particularly FIG. 2, will prove an aid to understanding.

The machine 1 comprises a base 2 made up of cast iron or steel parts and of concrete. Base 2 is extremely massive; the weight of the entire machine is on the order of seven metric tons. Passages 3 are provided in base 2 for the insertion of arms or other hoisting means; the machine is transported with the aid of special means of conveyance. The frame also includes an upright portion 4 integral and forming one body with base 2 and identically made up of cast iron or steel parts and a block of concrete. In front, a relatively thin wall 5, likewise made of ferrous material and concrete, rises to the working level of the machine. Two trough portions 6 and 7 are secured at the left and right, respectively, of the frame; with front wall 5 and one face of frame upright 4, these trough portions form a vat in which lubricating fluid is collected. Drain and filter means (not shown) are provided at the lowest part of the vat thus formed. Within the vat, resting on base 2, is a longitudinally supported table-beam 8 extending over the entire width of the machine, from one end of the vat to the other—approximately 3.5 meters in a reduction to practice. Table-beam 8 is extremely stable, anchored as it is in the concrete of base 2. Sliding on table-beam 8 is a table proper 9, the length of which is approximately one-quarter or one-third that of table-beam 8. Means (not shown) are provided for displacing table 9 on the fixed table-beam 8.

A grinding-wheel support block 11, fixed during operation, is secured to the front of frame upright 4 via a high-precision perpendicularity-adjustment device 10 to be explained in detail below. What is important is that block 11 be fixed very firmly and over a maximum area against upright 4, for the vibration produced in block 11 is not effectively dissipated in the massive upright 4 unless there is excellent mechanical conduction between those parts. It will be seen that there are two perpendicularities to be adjusted in this machine.

Block 11 bears a cylindrical spindle sleeve 12 which includes an axially displaceable portion. This axial, i.e., vertical, movement is controlled by the rotation of a pulley 13 fixed on spindle sleeve 12 above block 11. Pulley 13 is driven via a belt 42 by a spindle-sleeve-displacing motor 41 secured to the top of frame part 4. The axially displaceable portion of spindle sleeve 12 bears at the end a high-power (up to 50 hp or even more) grinding-wheel drive motor 14. Within spindle sleeve 12 there are also ball bearings which guide an extension of the rotary shaft of motor 14. Mounted at the other end of this shaft, i.e., below block 11, is a grinding-wheel 15 of the bell or dish type, substantially horizontal and rotating about a substantially vertical axis. Grinding-wheel 15 includes an abrasive rim 16 of standard type. Rim 16 is preferably made up of segments of an annulus; such a segmented construction of the abrasive rim of the bell grinding-wheel is generally preferred for large diameters. The diameter of grinding-wheel 15 with its abrasive rim 16 is typically 60 or 90 cm.

The plane of rotation of the active surface of rim 16 is substantially parallel to that of the supper surface of table-beam 8 and table 9. Rim 16 has an outside diameter, visible in FIG. 1, and an inside diameter, not visible, with a free inner area left within the rim. Table 9 (or at least the surface to be ground on the workpiece disposed on table 9) is narrower than the inside diameter of rim 16.

It is readily apparent that if grinding-wheel 15, and above all the active surface of rim 16, is positioned at a suitable level, and if table 9 bearing one or more workpieces is moved along beneath rim 16, the latter will grind the top surface of those workpieces. Up to this point, the design is more or less the same as in machines currently on the market.

Figure 2:
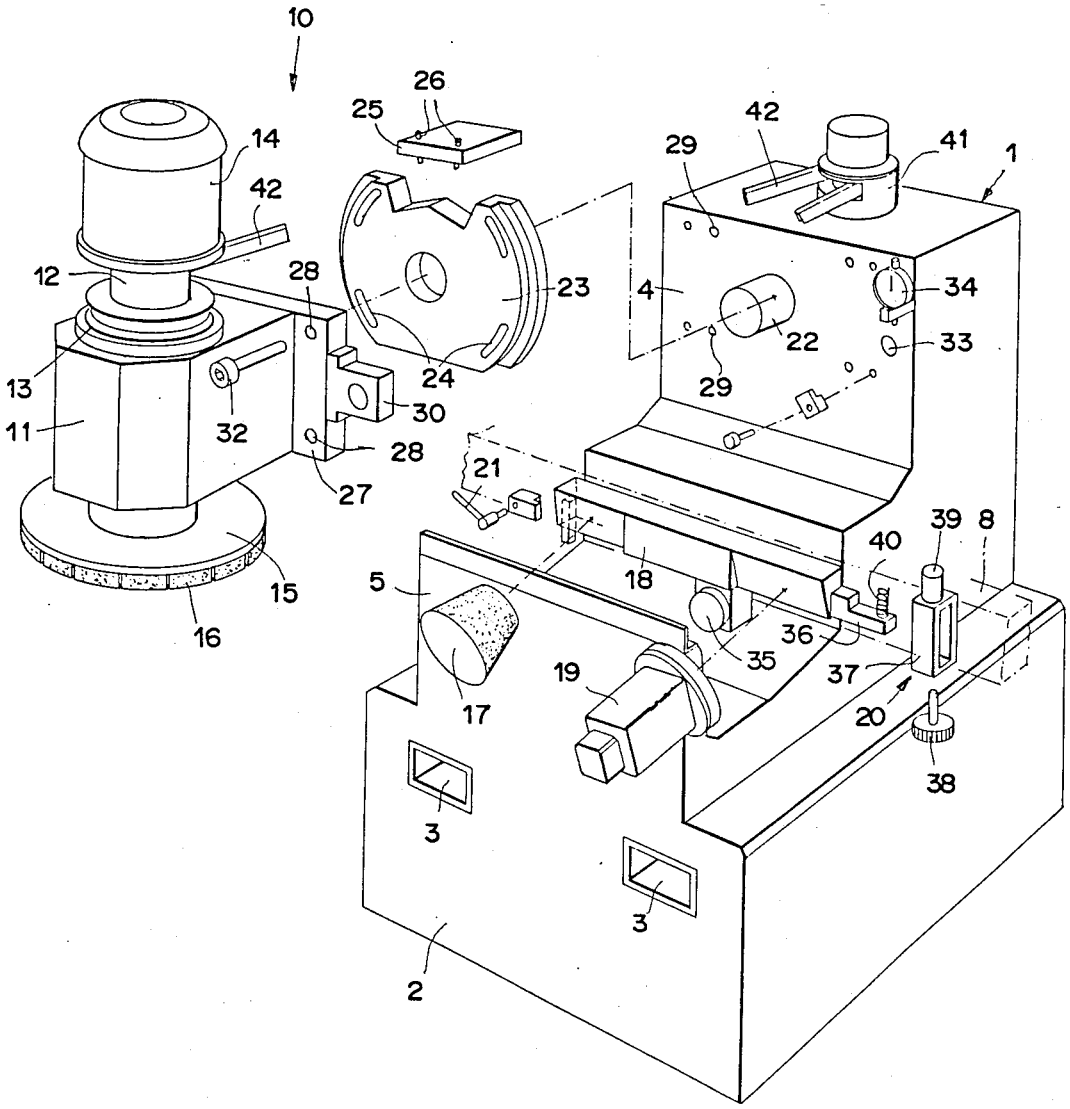
FIG. 2 is an exploded perspective view showing more explicitly the construction of the central part of the machine of FIG. 1.
Figure 3:
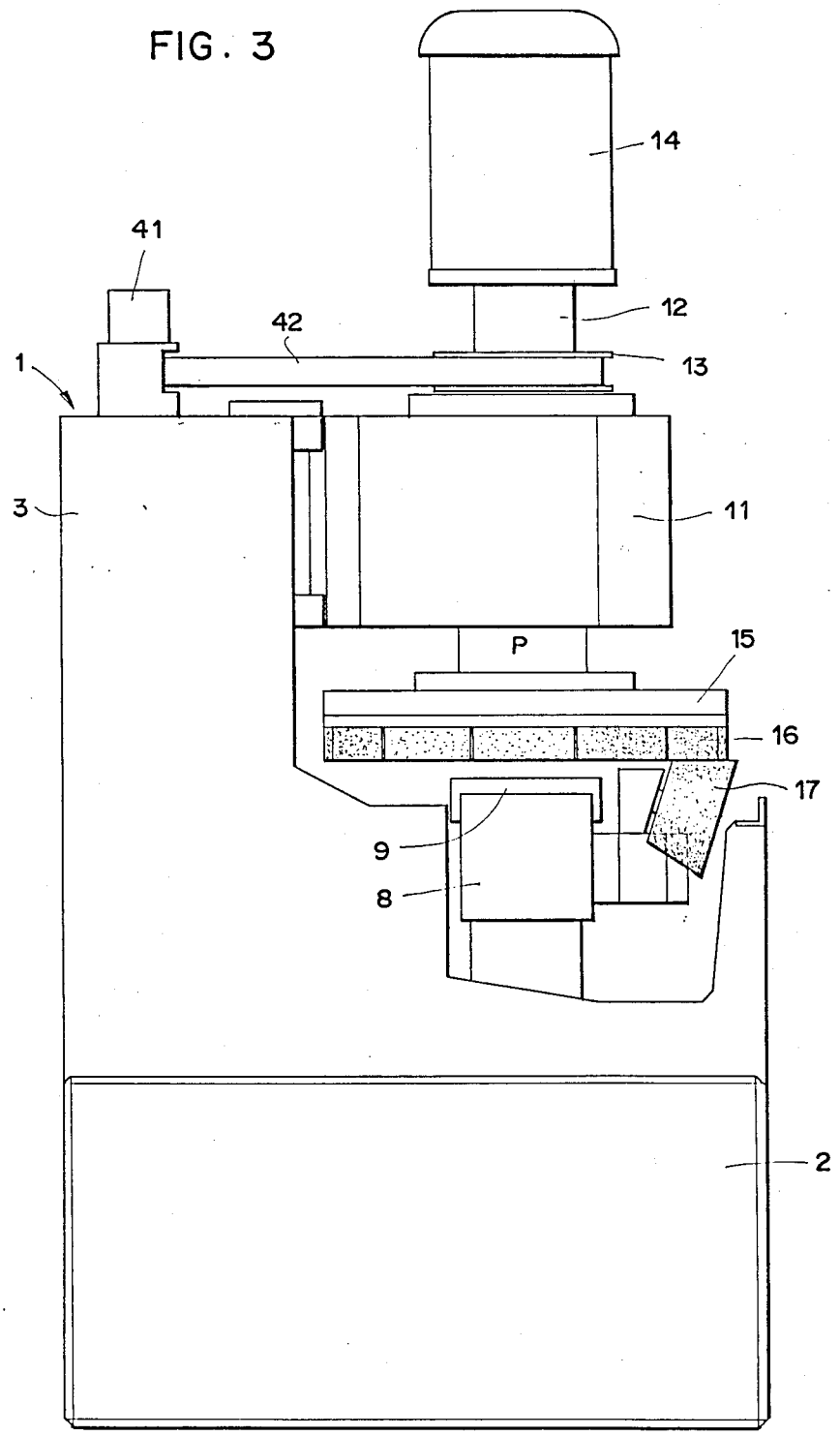
FIG. 3 is a diagrammatic elevation of the machine of FIGS. 1 and 2, also illustrating the principle of the grinding method according to the invention.

However, one absolutely novel feature which distinguishes the machine proposed here from the prior art is the position and mode of operation of a grinding-wheel-dressing diamond cutter-wheel 17. For convenience in illustration, FIG. 1 shows grinding-wheel 15, 16 in raised position. FIG. 3, an elevation corresponding to FIGS. 1 and 2 and using the same reference numerals, shows machine 1 in working position, with a workpiece P fixed to table 9, and makes clear the particular mode of co-operation between cutter-wheel 17 and abrasive rim 16.

This operation will now be explained in detail with reference to FIG. 4, a diagrammatic partial elevation showing grinding-wheel 15 with abrasive rim 16, diamond cutter-wheel 17, and a workpiece P resting on table-beam 8. Symbolized on each side of workpiece P, as well as on the top of table-beam 8, are means for the linear feed of this workpiece, which may equally well be a honeycomb-type cartridge containing a plurality of workpieces. Arrows indicate that grinding-wheel 15 rotates, that cutter-wheel 17 rotates, and that grinding-wheel 15 descends axially (very slowly). The cutter-bearing arrangement shown in FIG. 4 is not identical to that of FIGS. 1–3 but is drawn to illustrate the principle of this grinding operation. It will be seen to comprise a lateral carriage which can slide vertically relative to the table, but solely for preliminary adjustment purposes as the level of the cutter-wheel is absolutely fixed during operation.

Cutter-wheel 17 is conical and rotates about an oblique axis so that its uppermost generatrix is horizontal. Moreover, the axis of rotation of grinding-wheel 15, as seen in FIG. 4, must be completely perpendicular to the surface of the table. Under these conditions, the grinding-wheel is dressed at the very time it is carrying out its grinding function. The level of the uppermost generatrix of conical cutter-wheel 17 above the table exactly determines the grinding depth H of workpiece P. Under these circumstances, it is possible to use a very low-attrition grinding-wheel (and no longer a high-attrition self-dressing grinding-wheel), and the grinding-wheel is moved axially downward to an extent just barely greater than its natural attrition. Thus, the grinding-wheel is constantly redressed in its plane of operation at the same time as it grinds the top surface of workpiece P. There are no more "tolerance waves." Contact between the grinding-wheel and the cutter-wheel provides rolling friction, the frustoconical shape of the cutter wheel giving a smaller radius to the portions in contact with the inside edge of the rim and a proportionally greater radius to the portions in contact with the outside edge of the rim.

This condition, with a speed ratio of 1:1 (or rolling condition), yields the best dressing of the grinding-wheel from the point of view of its degree of cutting, of its effectiveness of abrasion. To obtain, on the other hand, extremely fine grinding but with less great abrasion, the cutter-wheel may be rotated at a different speed, or even in the opposite direction. The result is then a dressing of the grinding-wheel with less cutting grain, ensuring great fineness of the ground surface. The speed of rotation of the cutter-wheel is controlled by an electric motor, typically a universal commutator motor (DC motor), the speed parameter being established in a control calculator of the machine, taking into account the speed of rotation of the grinding-wheel (typically 20 to 70 m/sec) and the desired surface condition, the arasive material used, etc. FIG. 4 clearly shows that it is very important to have excellent perpendicularity between the surface of the table and the axis of rotation of the grinding-wheel.

Figure 5:
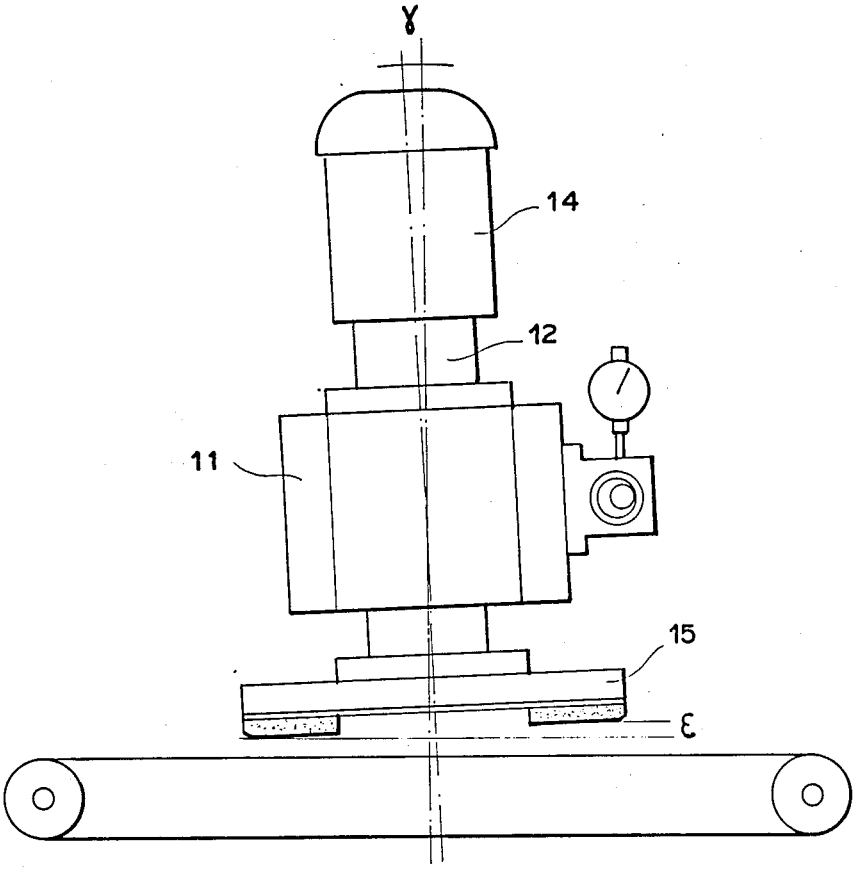
FIG. 5 is a diagrammatic front elevation illustrating one possibility of grinding a workpiece with the machine and method of the invention.

FIG. 5 is a view analogous to FIG. 4, but showing the relationships which arise longitudinally. In theory, the machine would operate perfectly well with complete perpendicularity between the surface of the table (longitudinally) and the axis of rotation of the grinding-wheel. The workpieces will effect two successive passes under the abrasive rim: the first pass will remove the desired material, the second will produce a simple "sparking." However, if it is desired that both passes under the rim cause an appreciable removal of material, a very slight deviation $\gamma$ in perpendicularity (greatly exaggerated in FIG. 5) may be given to the axis of the grinding-wheel. Assuming that the workpiece passes first under the part of the rim farthest from the table, then under the closest part, owing to the inclination $\gamma$, the second pass will remove a further quantity $\epsilon$ of material. In reality, the angle $\gamma$ is not even noticeable; the corresponding slope would be determined by the relationship between the depth of a material-removal pass and the average diameter of the abrasive rim. Drawn to scale, the angle $\gamma$ would be invisible.

FIGS. 4 and 5 have shown the great importance of the two perpendicularities (transverse and longitudinal) of the axis of rotation of the grinding-wheel. The transverse perpendicularity must be absolute. The longitudinal perpendicularity must be virtually absolute; it may be made to deviate by a fraction of a per mill ($1°/_{oo}$ yields $\epsilon=0.6$ mm for a rim diameter of 60 cm). This is the reason for the extremely fine perpendicularity adjustment arrangement, which will now be explained with reference to FIGS. 2, 9, and 10.

Figure 9:
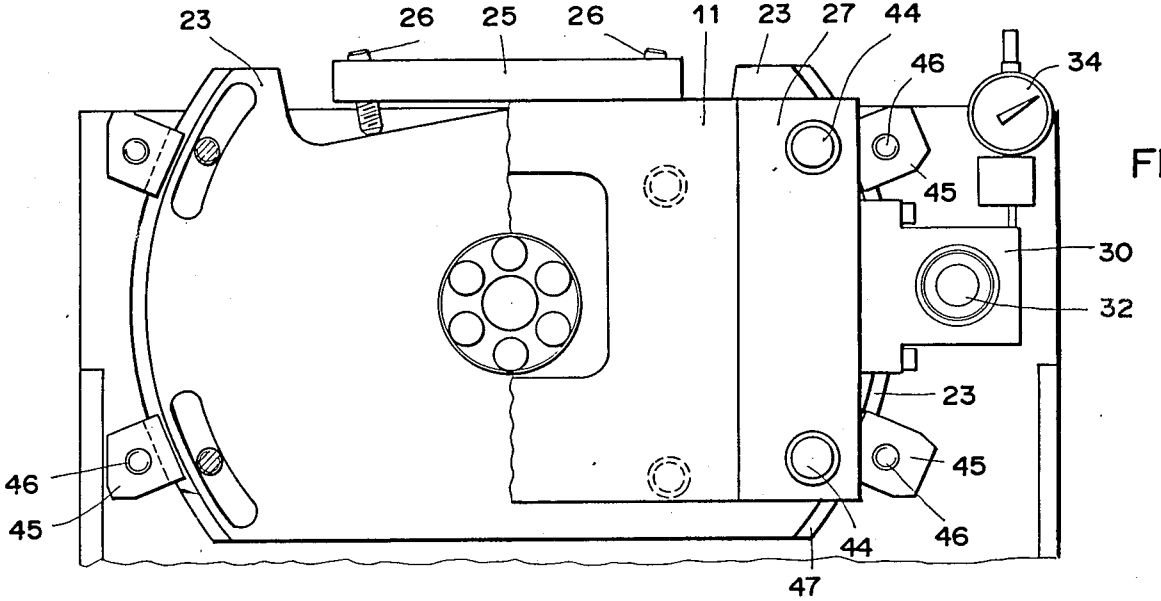
Figure 10:
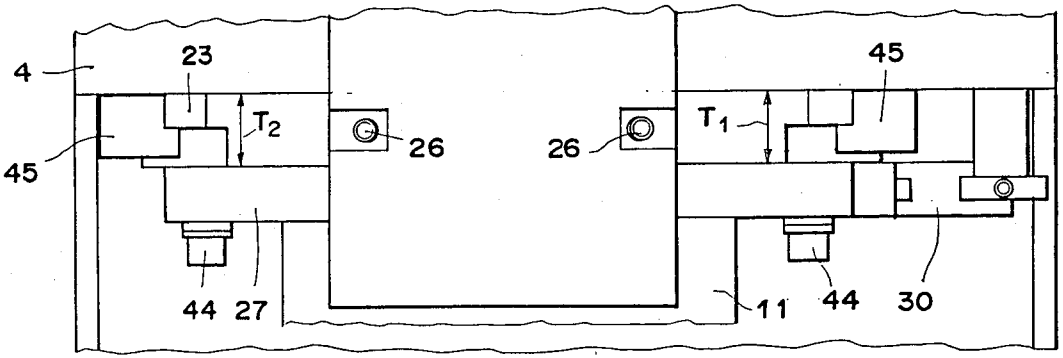

Upright 4 bears a cylindrical precision hub 22 which enters an equally precise bore (not visible in the drawing) in block 11. The latter includes a securing base plate 27 having holes 28 through which block 11 is fixed to upright 4, with hub 22 fitting into its bore. According to ordinary mechanical standards, this assembly would have perfect perpendicularity—transversely, through the very precision of the parts secured to one another, and longitudinally, through the care taken by the mechanic carrying out the assembly. Here, however, much greater precision must be achieved. This is the reason for the provision of a brace plate 23 having four arcuate apertures for the fixing screws connecting block 11 to frame portion 4. This brace plate, or support part, 23 has the particularity of presenting a "false parallelism." Although it is not visible to the naked eye, the right-hand side is about 1 mm thicker than the left-hand side (or vice versa). If plate 23 is mounted with its flat base horizontal, as shown in FIGS. 1, 2, and 9, block 11 is half a degree "off" to the left or to the right, but this has no effect at all as the axis of rotation of the grinding-wheel remains vertical. If brace plate 23 is rotated without changing the position of block 11, the parallelism between the axis of the grinding-wheel and the front face of upright 4 is very slightly modified. A quarter of a turn of plate 23 would result in a fraction of a degree, but this brace plate itself will never be turned more than a few degrees, the possible extent of rotation being governed by the length of arcs 24. The rotation of plate 23 therefore acts in the manner of a reducer of angular deviation; rotation of brace plate 23 by a few degrees causes tipping of the axis of rotation of the grinding-wheel a hundred times smaller (a few tenths of a percent). This adjustment by means of plate 23 is carried out once and for all at the time of assembly in order to enhance the accuracy of the transverse perpendicularity still further.

As for the longitudinal perpendicularity of the axis of rotation of the grinding-wheel, it must be possible to subject it to a slight deviation, still within a range where only instruments can provide reliable measurements. An adjusting lug 30 is therefore fixed to the side of base plate 27 of block 11. A comparator 34, attached to the front face of frame part 4, rests against block 11. The latter is held against frame part 4 by screws 44 passing through holes 28 and 29; these screws preferably pass all the way through frame part 4, at the back of which they are fixed by nuts. Block 11 is secured as perpendicular as possible, whereupon grinding tests are carried out to determine whether the deviation in perpendicularity ($\gamma$ in FIG. 5) is suitable. If not, it must be corrected. For this purpose, screws 44 are loosened slightly, and an eccentric screw 32, passing through a bore in lug 30, is acted upon. This eccentric works on a fraction of a millimeter at the location of lug 30, and only comparator 34 makes it possible to detect the minute variation of angular devication $\gamma$. Once the absolutely perpendicular position has been found, the scale of comparator 34 may be positioned accordingly, and deviation $\gamma$ may be read on comparator 34; the latter may also be graduated directly in microns. After adjustment by means of eccentric 32, the four screws 44 are retightened.

In principle, the position of plate 23 having false parallelism is not changed once the initial adjustment has been carried out. The exact position of plate 23 is fixed by lugs 45, held by screws 46 and acting upon a rim 47 of this plate (FIG. 9). If necessary, plate 23 may be displaced, e.g., after the machine has been transported. For this displacement, which may amount to a few degrees as it is greatly reduced, screws 46 and 44 are loosened. Plate 23 is rotated by acting via two adjusting screws 26 passing through a plate 25 secured to the top of frame part 4; one of the screws 26 is unscrewed by a certain amount, and the other is screwed in until it is blocked again, so that brace plate 23 is rotated. After repositioning of the transverse perpendicularity by means of plate 23, which need be done very rarely, it is preferable to readjust the longitudinal perpendicularity by means of eccentric 32.

FIGS. 1, 2, 9, and 10 show clearly the operation of the perpendicularity-adjustment device, which is essential for this type of grinding. It will be noted that the system adopted, with brace plate 23 having false parallelism, allows two adjustments perpendicular to one another while ensuring very compact fixation. It is a question of angular corrections having to adjust microns at the end of a lever measurable in decimeters. It will be understood that the precision required is enormous, and that besides very fine adjusting means, it demands extremely high rigidity of form, obtained in this instance by co-operation between a cast-iron frame and a poured mass of concrete.

Figure 6:
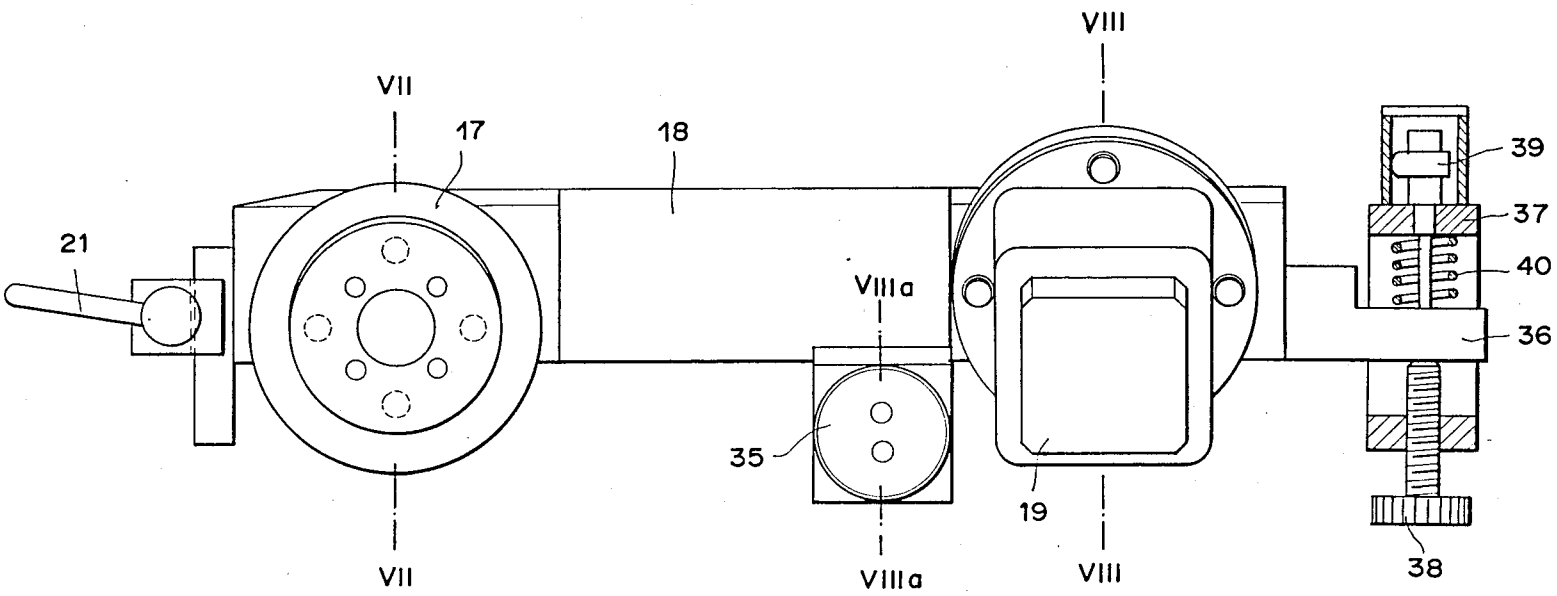
FIG. 6 is a detail of the machine of FIG. 1, showing a cutter-bearing lever with its motor and its various fittings.
Figure 7:
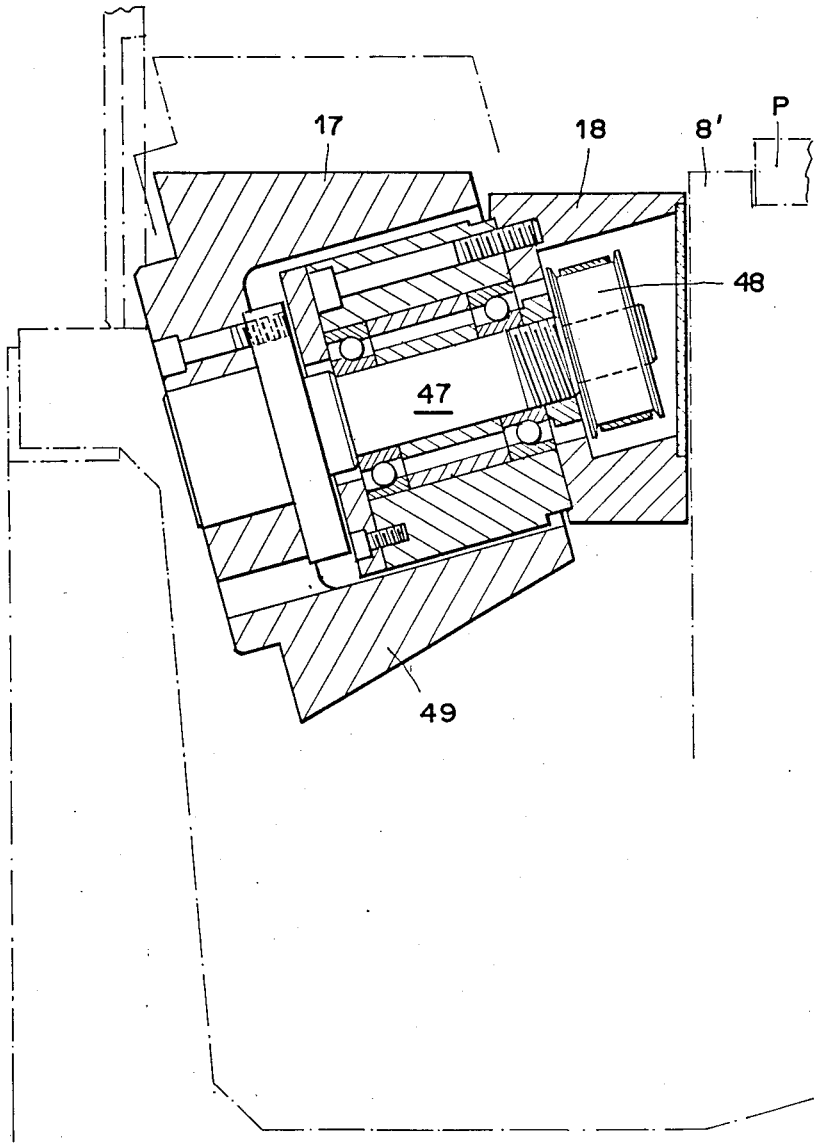
FIG. 7 is a section taken on the line VII—VII of FIG. 6.
Figure 8:
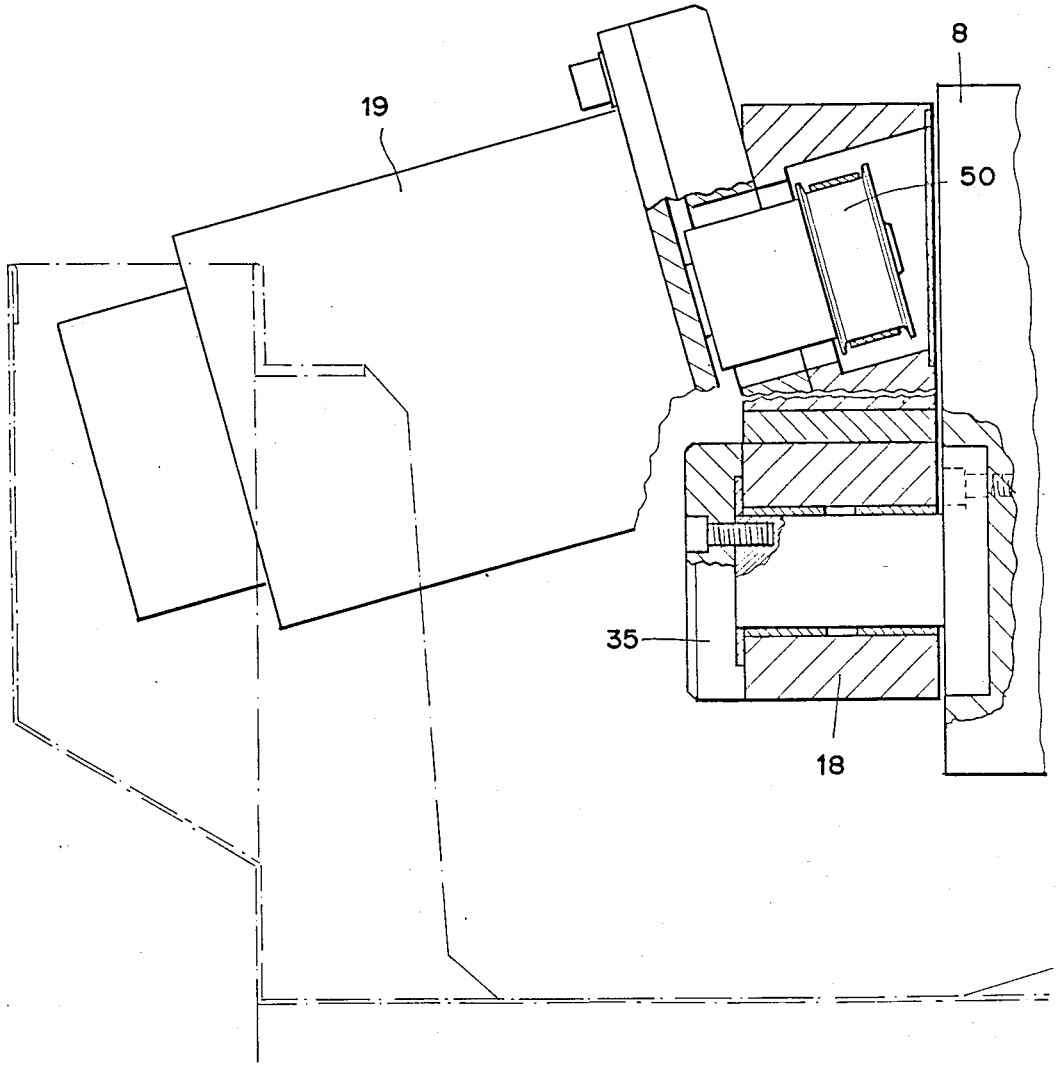
FIG. 8 is a section taken partially on the line VIII—VIII and partially on the line VIIIa—VIIIa of FIG. 6, and FIGS. 9 and 10 are an elevation and a top plan view, respectively, showing in detail the upper arrangement of perpendicularity adjustment of the machine of FIGS. 1 and 2.

FIGS. 6–8 show, in more detail than FIGS. 1 and 2, the mechanism by which the level of the diamond cutter-wheel is established. It will be recalled (cf. H, FIG. 4) that the thickness of the ground workpiece will correspond exactly to the level occupied by the cutter-wheel (or more exactly, by the uppermost generatrix of the cutter-wheel) relative to the surface of the table. Used for this purpose is lever 18, pivoted at point 35 and bearing cutter-wheel 17. Lever 18 is seen to pivot relative to table-beam 8 and to include two parts milled obliquely for fixing the cutter-wheel and its motor 19. FIG. 7 shows how a pulley 48 rotates an oblique shaft 47 in a ball-bearing support unit fixed against the oblique wall of lever 18. The active portion of diamond cutter-wheel 17 is formed by a part 49 which surrounds the bearing support unit and which may, if necessary, be exchanged without the whole bearing device having to be taken apart. As shown in FIG. 8, motor 19 is similarly mounted against an oblique face of lever 18 and bears a pulley 50 connected by a belt to pulley 48 of the cutter-wheel. To make room for cutter-wheel motor 19, trough portion 7 (FIG. 1) is widened at the right.

The exact vertical positioning of cutter-wheel 17 is determined by an arrangement 20 which comprises one end 36 of lever 18, a fixed cage 37, an adjusting screw 38, and a spring 40. The end, or finger, 36 of lever 18 rests against screw 38, and spring 40 situated on finger 36 presses the latter firmly against the screw. A comparator sensor 39 attached to cage 37 reads the exact position of finger 36 and hence of lever 18.

In a reduction to practice, screw 38 was adjusted manually, butit is intended that the adjustment be carried out by an electronically controlled servo-motor. Next to cutter-wheel 17 is a lever 21 for locking lever 18 so that no undesirable vibration will occur. This is a braketype locking, acting through friction. Screw 38 and spring 40 are so positioned that if there should be a very hard scrap of metal stuck under abrasive rim 16, cutter-wheel 17 can move aside against the bias of spring 40. As soon as the scrap has passed, spring 40 will return cutter-wheel 17 to the exact required position determined by screw 38. The locking friction of lever 21 will be less than the bias of spring 40 and will therefore not interfere with its operation.

There are various possibilities of moving the workpieces along the grinding path, which causes them to make two successive passes under abrasive rim 16. Table 9 shown in FIG. 1 may have lugs or hooks by means of which a large-size workpiece may be fixed to that table, which then moves along on fixed table-beam 8. If the workpieces are small, they may be mounted in pallets, i.e., in a frame having honeycomb-type cells. The workpieces—round ones, for example—will be placed in these cells and the frame fixed to table 9. In this way, a large number of workpieces will be ground with just one pass of the table under the abrasive rim. This last manner of use, with pallets, suggests a design modification in which there would be no table 9, and table-beam 8 itself would serve as the table. The means (not shown) for attaching the workpieces or pallets to table 9 in the embodiment of FIG. 1 would be combined with the means (also not shown) for advancing that table to form combined attaching and advancing means which would grip the pallets and slide them along table beam 8. As the pallets would be of an easily machinable or moldable material (light metal, plastic, wood, ceramics, etc.), they could readily be given hook shapes which would facilitate seizing and displacement of these pallets, the reference surface remaining the table on which the workpieces slide in the honeycomb cells.

There might also be envisaged, as illustrated in FIG. 7, a modification in which a fixed table 8' comprises a rim against which the pallets rest and slide, driving means being situated on the other side of the pallet. This arrangement can easily be carried out as long as the pallets can be standardized.

FIG. 5 supposes the use of a conveyor belt of very uniform thickness, sliding on a table. This modification can be used only when the required precision is not greater than the tolerance of thickness of a conveyor belt. Finally, FIG. 4 shows a table-beam 8 on which longitudinal guiding and driving members are secured, with workpiece P sliding on the table.

It must be borne in mind that all the operations take place under heavy lubrication and that the modalities of friction and gripping are to be determined taking the lubrication into account. A modification with hydraulic or pneumatic displacement means has also been contemplated.

On the other hand, when table 9 of FIG. 1 is used, provision may be made, in a manner known per se, for magnetic attachment means inasmuch as the workpieces are usually of materials sensitive to the action of magnetic fields.

If pallets are used, placed on table 9, for example, it will be of advantage to provide for loading and unloading of the pallets on the same side of the machine. The last pass under the grinding-wheel will then take place as a finishing "sparking."

FIGS. 4*a* and 4*b*, appearing in conjunction with FIG. 4, show modified cutter-wheels by means of which the grinding-wheel may be given an oblique biting flank before its horizontal surface. Depending upon whether the grinding-wheel works from the outside or from the inside, the particular modification of FIG. 4*a* or 4*b* will be used. The rolling effect (identical linear speeds at the contact locations) will be substantially present nonetheless with the special forms of FIGS. 4*a* and 4*b*.

It will be noted that the bell grinding-wheel might very well be of compact design instead of in segments. One important particularity resides in the continuous dressing by means of an arrangement of cutter wheels such as are shown in FIG. 4.

It is self-evident that protective screens are disposed in front of and around the grinding-wheel. A mutual locking system ensures that the grinding-wheel cannot be started rotating at high speed as long as the protective screens are not in place, and that the latter cannot be retracted as long as the grinding-wheel is rotating.

What is claimed is:

1. A machine for grinding a flat surface, comprising:

a frame supporting at least one rotary grinding-wheel, means for rotating said grinding-wheel about an axis of rotation, positioning means for receiving at least one workpiece having a surface to be ground, translatory displacement means for effecting relative displacement between said rotary grinding-wheel and said workpiece disposed in said positioning means, and a diamond cutter-wheel for dressing or redressing said grinding wheel, said grinding-wheel being a bell grinding-wheel having an abrasive rim and a recessed inner area of a predetermined diameter, said grinding-wheel having its said axis of rotation substantially perpendicular to said surface to be ground, said positioning means and said translatory displacement means being arranged to dispose the surface of said workpiece to be ground in a grinding path that is substantially perpendicular to said axis of rotation of said bell grinding-wheel and to move said surface along said path in facing relationship to said grinding-wheel, said path being narrower than the diameter of said inner area of said grinding wheel and intersecting said rim of said grinding-wheel at two diametrically opposed points thereon, said diamond cutter-wheel being disposed on one side of said path under said rim for engaging said rim with a dressing generatrix in the plane of said surface to be ground, and means for imparting to said grinding-wheel a slow axial movement, corresponding at least to the attrition of said grinding-wheel as said surface is ground, for ensuring continuous dressing of said abrasive rim of said grinding-wheel by said cutter-wheel, at a level that continuously corresponds to the plane of grinding of said surface to be ground.

2. The grinding machine of claim 1, wherein said diamond cutter-wheel is rotatingly driven by an electric motor whose speed of rotation, can be controlled.

3. The grinding machine of claim 1 wherein said cutter-wheel is conical in configuration, said cutter-wheel being so positioned relative to the abrasive rim of said grinding-wheel that there exists, between a first radius of said cutter-wheel where the generatrix of said cutter-wheel touches said abrasive rim at a first radius of the bell grinding-wheel and a second radius of said cutter-wheel where said generatrix touches said abrasive rim at a second radius of the bell grinding-wheel, a ratio which is substantially the same as the ratio of said first and second radii of the bell grinding-wheel, the arrangement and configuration of the cutter-wheel relative to the abrasive rim of the grinding-wheel furnishing, over substantially the entire said generatrix, a speed ratio equal to 1, i.e., a rolling effect, for at least one value of the speed of rotation of the cutter-wheel thereby to dress said grinding wheel roughly so as to insure a great effectiveness of abrasion, and means for changing the speed of rotation of the cutter-wheel to produce a speed ratio different from 1 for dressing said grinding-wheel less roughly so as to ensure a great fineness of the ground surface.

4. The grinding machine of claim 1 wherein said abrasive rim of the grinding-wheel is cylindrical, and said cutter-wheel has a longitudinal section adapted to produce an oblique biting flank on a portion of the radial section of the rim of said cutter wheel.

5. The grinding machine of claim 1, wherein said abrasive rim of the bell grinding-wheel is formed of abrasive segments fixed on a rotary plate.

6. The grinding machine of claim 1 wherein said positioning means comprises a table, said cutter-wheel being mounted on a block whose position is adjustable relative to the table so as to allow precise adjustment of the level of said dressing generatrix relative to the plane of the table, said relative level of the dressing generatrix defining the thickness of the workpiece resulting from the grinding operation.

7. The grinding machine of claim 6 wherein said block is a substantially horizontal lever pivotally mounted at a median point about a horizontal axis, one end of said lever, disposed at a right angle to the axis of rotation of the grinding-wheel, having said cutter-wheel mounted for rotation thereon about an oblique axis so that the uppermost generatrix of said cutter-wheel is horizontal, the other end of said lever comprising stop means for adjustably fixing the horizontal orientation the lever, and hence the exact height of said uppermost generatrix of the cutter-wheel, said lever also supporting motor means thereon for driving the cutter-wheel in rotation.

8. The grinding machine of claim 7, wherein said stop means comprise an adjustable stop against which said other end of the lever is pressed by spring in means so that the cutter-wheel is exactly and firmly positioned buts can move aside under the impact of a very hard piece of scrap which might be situated just under the rim of the grinding-wheel and which would result in a force great enough to over-come the pressure of said spring means.

9. The grinding machine of claim 1 wherein the bell grinding-wheel is supported by bearing means arranged to allow adjustment of the perpendicularity of the axial direction of the grinding-wheel on the surface to be ground in the longitudinal direction of the grinding path, said adjustment being capable of providing a slight angular deviation to said perpendicularity to shift the levels of grinding bite respectively at two diametrically opposed grinding portions of the abrasive rim, said deviation being adjustable at least up to the value of the ratio between the depth of maximum permissible bite and the average diameter of the abrasive rim, and means on said machine for determining the exact extent of said slight angular deviation.

10. The grinding machine of claim 1, comprising means including a brace plate having false parallelism for exactly adjusting the perpendicularity between the axis of the grinding-wheel and the surface to be ground in the transverse direction of the grinding path.

11. The grinding machine of claim 1 wherein said positioning means comprises a fixed table, and means for conveying workpieces along said table.

12. The grinding machine of claim 1 wherein said positioning means comprises a movable table for supporting workpieces thereon, the grinding path being defined by the trajectory of workpieces moving with the table.

13. The grinding machine of claim 1, wherein said frame includes concrete in a cast iron or steel structure.

14. The grinding machine of claim 1 comprising electronic control means for adjusting the angular position of the axis of the grinding-wheel and the position of the cutter-wheel, and electronic means for monitoring said adjustments.

15. A method of grinding at least one flat surface with the aid of at least one rotary grinding-wheel, comprising the steps of: rotating a bell grinding-wheel, having an abrasive rim and a recessed inner area of a predetermined diameter, about an axis that is substantially perpendicular to the surface to be ground, positioning at least one workpiece having a surface to be ground, so that said surface is disposed on a grinding path which passes opposite the grinding-wheel and which is substantially perpendicular to the axis of the grinding-wheel, said path being narrower than the diameter of the said inner area, crossing said inner area, and intersecting the abrasive rim of the grinding-wheel at two points of intersection, effecting relative translatory movement along said path between the grinding-wheel and the workpiece, positioning a diamond cutter-wheel adjacent one side of said path, under the rim of said grinding-wheel, so as to engage the rim with a dressing contact in the plane of the surface to be ground, and effecting a slow axial movement of the grinding-wheel toward the workpiece and the cutter-wheel thereby to ensure continuous dressing of the abrasive rim against the cutter-wheel and to define continuously the grinding plane of the said surface.

16. The method of claim 15 wherein said cutter-wheel is rotated at different speeds and directions of rotation to produce:

(a) a rolling effect which dresses the grinding-wheel roughly so that said grinding-wheel exhibits a high degree of cutting to ensure great effectiveness of abrasion, and (b) a friction effect which dresses the grinding-wheel less roughly so that said grinding-wheel has a less cutting grain to ensure great fineness of the ground surface.

17. The method of claim 16 wherein the abrasive rim of said grinding-wheel is cylindrical and said cutter-wheel is at least partially conical, said cutter-wheel having a longitudinal section which engages a radial section of the grinding-wheel rim to effect a good grinding bite of said rim, at least the major part of the longitudinal section of the cutter-wheel having a conicity which ensures a complete absence of friction between said cutter-wheel and grinding-wheel when said rolling effect is produced.

18. The method of claim 15 wherein the axis of the grinding-wheel is held in an orientation that is not exactly perpendicular to the surface to be ground in the longitudinal direction of said path, thereby to produce a slight angular deviation which gives said rim, at one said point of intersection, a position that is lower than that of the other said point of intersection, the difference between the positions of said two points of intersection defining the depth of a grinding pass.

19. The method of claim 18 wherein said relative translatory movement is carried out by displacement of said workpiece without axial displacement of the grinding-wheel, said workpiece being so moved along said path that it first engages said grinding-wheel at the higher one of said two points of intersection and thereafter engages said grinding-wheel at the lower one of said two points of intersection.

* * * * *